US005494281A

United States Patent [19]

Chen

[11] Patent Number: 5,494,281

[45] Date of Patent: Feb. 27, 1996

[54] GOLF CLUB HEAD

[76] Inventor: Archer C. C. Chen, 35, Yichaone E. Road, Taipin, Taichung County, Taiwan

[21] Appl. No.: 375,994

[22] Filed: Jan. 20, 1995

[51] Int. Cl.[6] ..... A63B 53/04

[52] U.S. Cl. ..... 273/78; 273/167 H; 273/173

[58] Field of Search ..... 273/167 R, 167 H, 273/173, 78, 167 J, 193 R, 194 R, 77 R, 77 A, 169, 167 F, 175

[56] References Cited

U.S. PATENT DOCUMENTS 4,749,197 6/1988 Orlowski ..... 273/167 H
5,028,049 7/1991 McKeighen ..... 273/167 H
5,205,560 4/1993 Hoshi ..... 273/167 H
5,288,070 2/1994 Chen ..... 273/167 H
5,322,206 6/1994 Harada ..... 273/167 R X
5,346,217 9/1994 Tsuchiya ..... 273/167 H

*Primary Examiner*—Sebastiano Passaniti
*Attorney, Agent, or Firm*—Browdy and Neimark

[57] ABSTRACT

A golf club head comprises a shock-absorbing casing of a magnesium alloy and an elastic plate of an aluminium alloy, a titanium alloy, or a ceramic material. The casing has a shape similar to that of a golf club head and further has a hollow interior corresponding in location to and in communication with a ball striking face of the golf club head. The elastic plate is fastened securely to an open end of the hollow casing such that the elastic plate forms the ball-striking face of the golf club head.

5 Claims, 1 Drawing Sheet

GOLF CLUB HEAD

FIELD OF THE INVENTION

The present invention relates generally to a golf club head, and more particularly to a golf club head having a high ball-striking resilience and an excellent shock-absorbing property.

BACKGROUND OF THE INVENTION

The conventional wooden head of a golf club is generally made of persimmon wood and is solid. The golf club head of persimmon wood has an excellent shock-absorbing capability; nevertheless it has a mediocre ball-striking resilience. As a result, it is generally not easy for a golf player to hit a ball to travel farther with such a conventional golf club head as described above. In addition, the conventional golf club head of persimmon wood does not generate a clear and sharp sound when it hits a golf ball. In order to overcome the shortcomings of the golf club wooden head, the face of the golf club wooden head is provided thereon with a metal ball-striking plate attached thereto. The metal striking plate serves to increase the hardness of the face and to decrease the wear of the scoring lines. In other words, the metal striking plate is limited in that it can not cause a golf ball to travel farther. The hollow golf club head of a stainless steel material or an aluminium alloy material has advantages in that it can hit a golf ball to travel farther and that it can hit a golf ball with a clear and sharp sound. However, the hollow golf club head of a stainless steel or aluminium alloy is generally poor in absorbing shock. It is conceivable that a golf player is rather susceptible to an elbow injury caused by the shock wave which is transmitted from the head face to the shaft of a golf club.

SUMMARY OF THE INVENTION

It is therefore the primary objective of the present invention to provide a golf club head having a great ball-striking resilience and an excellent shock absorbing capability.

It is another objective of the present invention to provide a golf club head of an extra large size and capable of generating a clear and sharp sound when it hits a golf ball.

The foregoing objectives of the present invention are attained by a golf club head, which is provided thereon with a face of a resilient material, and with a casing of a shock-absorbing material. The casing has a hollow interior for disposing an elastic plate corresponding in location to the head face. The golf club shaft is fastened with the shock-absorbing casing such that the shaft is not in contact with the elastic plate. The shock-absorbing casing is capable of absorbing the shock wave which is generated by the elastic plate when the elastic plate hits a golf ball.

DETAILED DESCRIPTION OF THE INVENTION

Figure 1:
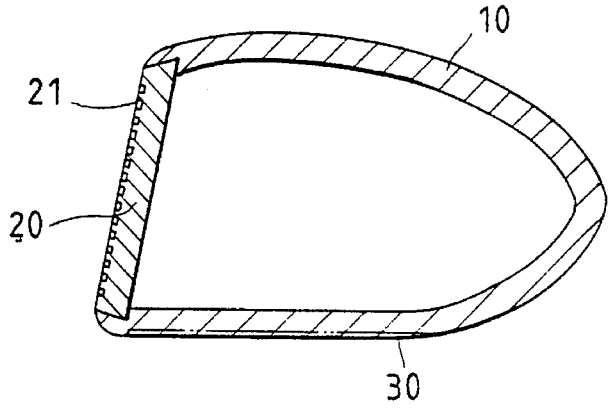
FIG. 1 shows a schematic view of the construction of a golf club head of the present invention.

As shown in FIG. 1, a golf club head embodied in the present invention comprises mainly a shock-absorbing casing 10 and an elastic plate 20.

The shock-absorbing casing 10 of a magnesium alloy has a shape similar to the shape of the main body of a golf club head, and a hollow interior in communication with and corresponding in location to the head face.

The elastic plate 20 of an aluminium alloy, a titanium alloy, or a ceramic material, is disposed in the open end of the hollow casing 10 to form the head face for hitting a golf ball.

The casing 10 is made integrally by dewaxing cast, injection die cast, or forging. The casing 10 can be also made of a plurality of prefabricated elements, which are joined together to form the casing 10.

The shock-absorbing casing 10 is provided with a bottom tray 30 for protecting the golf club head from wear. In addition, the bottom tray 30 may be used for attaching a weight to the golf club head or for engraving thereon a trademark.

The elastic plate 20 is provided on the outer surface thereof with a plurality of scoring lines 21. The elastic plate 20 is fastened with the casing 10 by screws, a heavy-duty adhesive, a fiber material impregnated with resin, or by welding.

Figure 2:
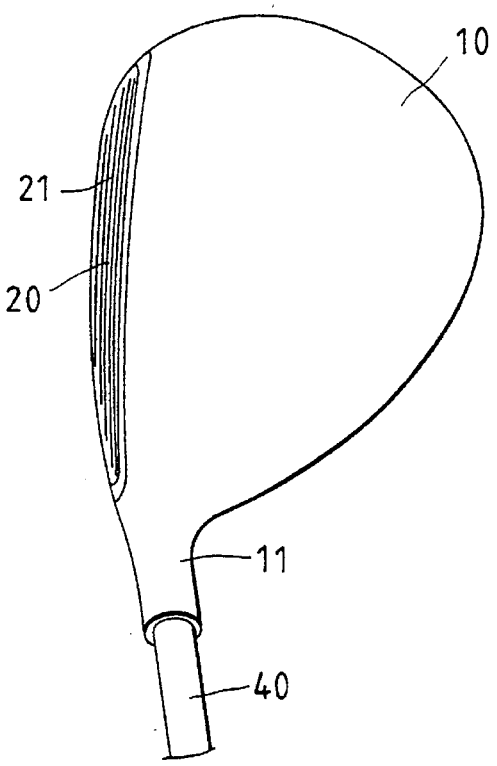
FIG. 2 is a top plan view of the golf club head of the present invention, showing the way that the golf club head is fastened with a golf club shaft.

As shown in FIG. 2, the shock-absorbing casing 10 is provided with a neck 11 having centrally a shaft hole dimensioned to receive therein securely one end of a golf club shaft 40.

Figure 3:
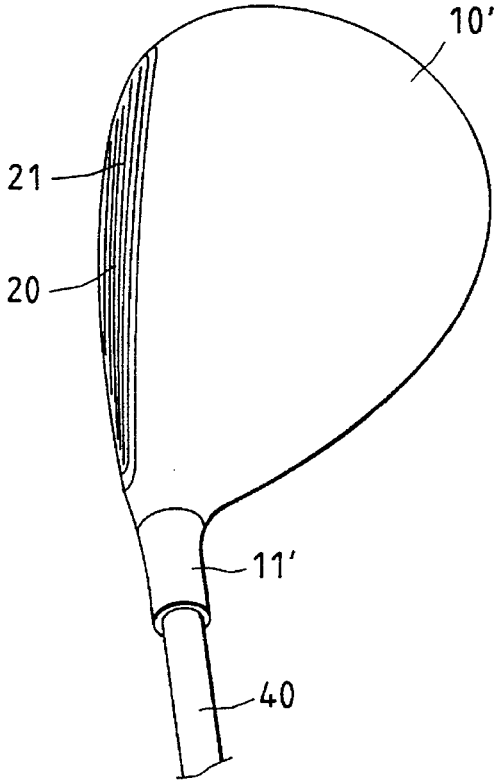
FIG. 3 is a top plan view of the golf club head of the present invention, showing another method of fastening the golf club head of the present invention with a golf club shaft.

As illustrated in FIG. 3, a shock-absorbing casing 10' of another preferred embodiment of the present invention is provided with a neck member 11' which is made of a material different from the material of which the casing 10 is made. The neck member 11' is intended for use in fastening the golf club shaft 40 with the golf club head of the present invention.

The elastic plate 20 of the golf club head of the present invention has inherent advantages over the prior art metal plate of a stainless steel in that the former is light in weight, and that the former has an excellent shock-absorbing capability, and further that the former can generate a clear and sharp sound upon hitting a golf ball, and still further that the former can be so made as to enlarge the size of the golf club head. It must be noted here that the specific gravity of stainless steel is about 7.8 g/cm$^3$, and that the specific gravity of titanium alloy is about 4.4 g/cm$^3$, and further that the specific gravity of aluminium alloy is about 2.8 g/cm$^3$, and still further that the specific gravity of magnesium alloy is about 1.8 g/cm$^3$. It is therefore estimated that the shock-absorbing capability of the golf club head of magnesium alloy is about 15 times greater than that of the golf club head of aluminium alloy.

What is claimed is:

1. A golf club head comprising:

a shock-absorbing casing of a magnesium alloy and having a golf club head shape, said casing further having a hollow interior corresponding in location to and in communication with a ball striking face of said golf club head; and an elastic plate of an aluminium alloy, a titanium alloy, or a ceramic material, said elastic plate being fastened to an open end of said interior of said casing such that said elastic plate forms said ball-striking face of said golf club head.

2. The golf club head according to claim 1 wherein said shock-absorbing casing has a neck provided with a shaft hole for receiving therein securely one end of a golf club shaft.

3. The golf club head according to claim 1 wherein said shock-absorbing casing is provided with a neck member fastened thereto for holding securely one end of a golf club shaft.

4. The golf club head according to claim 1 wherein said shock-absorbing casing is provided with a bottom tray fastened thereto.

5. The golf club head according to claim 1, wherein the elastic plate is rimless.

* * * * *